US007406290B2

(12) United States Patent
Choi et al.

(10) Patent No.: US 7,406,290 B2
(45) Date of Patent: Jul. 29, 2008

(54) WASTE TONER TRANSPORTING APPARATUS AND TONER CARTRIDGE HAVING THE SAME

(75) Inventors: Sam-Seok Choi, Suwon-si (KR); Dong-Hoon Park, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 339 days.

(21) Appl. No.: 11/305,297

(22) Filed: Dec. 19, 2005

(65) Prior Publication Data

US 2006/0159497 A1 Jul. 20, 2006

(30) Foreign Application Priority Data

Jan. 19, 2005 (KR) ..... 10-2005-0004987

(51) Int. Cl.
*G03G 21/00* (2006.01)
*G03G 21/10* (2006.01)

(52) U.S. Cl. ..... 399/350; 399/358

(58) Field of Classification Search ..... 399/350, 399/351, 358, 360

See application file for complete search history.

(56) References Cited

U.S. PATENT DOCUMENTS

| | | | | |
|---|---|---|---|---|
| 7,245,867 | B2 * | 7/2007 | Baek et al. | 399/358 |
| 7,266,338 | B2 * | 9/2007 | Baek | 399/350 |

FOREIGN PATENT DOCUMENTS

| | | |
|---|---|---|
| JP | 2004-102137 | 4/2004 |
| KR | 1988-012985 | 8/1988 |
| KR | 1999-029393 | 4/1999 |
| KR | 2002-0016388 | 3/2002 |
| KR | 2004-0002096 | 1/2004 |

* cited by examiner

*Primary Examiner*—William J Royer
(74) *Attorney, Agent, or Firm*—Roylance, Abrams, Berdo & Goodman, L.L.P.

(57) ABSTRACT

A waste toner transporting apparatus which transfers waste toner removed from a photosensitive drum to a waste toner housing is provided. The waste toner transporting apparatus includes a toner transporting plate arranged substantially above a cleaning blade. A transporting member is installed at one end of the toner transporting plate and has a cam follower arranged on an opposite side of the toner transporting plate. A driving cam contacts the cam follower and converts rotational motion into linear reciprocating motion to enable the toner transporting plate to reciprocate on the cleaning blade.

14 Claims, 5 Drawing Sheets

WASTE TONER TRANSPORTING APPARATUS AND TONER CARTRIDGE HAVING THE SAME

CROSS-REFERENCE TO RELATED APPLICATIONS

This application claims the benefit under 35 U.S.C. § 119(a) of Korean Patent Application No. 2005-4987, filed on Jan. 19, 2005, the entire disclosure of which is hereby incorporated by reference.

BACKGROUND OF THE INVENTION

Field of the Invention

The present invention relates to a toner cartridge used in an image forming apparatus. More particularly, the present invention relates to a waste toner transporting apparatus which is provided in the toner cartridge and transports the waste toner removed from a photosensitive drum.

In general, an electrophotographic type image forming apparatus is a printing apparatus in which an electrostatic latent image formed on a surface of a photosensitive drum is developed by a toner to form a visible image. Then, the developed visible image is transferred to a printing medium. However, after the visible image is transferred to the printing medium, the toner which is not transferred to the printing medium remains on a surface of the photosensitive drum. The remaining toner is referred to as waste toner which can not be used for developing new electrostatic latent images. Therefore, the waste toner should be removed from a surface of the photosensitive drum. Accordingly, conventional electrophotographic type image forming apparatuses typically comprise a waste toner removing unit which can remove such waste toner. In the electrophotographic type image forming apparatus, the toner cartridge is integrated with the photosensitive drum. Moreover, the waste toner removing unit is typically formed integrally with the toner cartridge.

Referring to FIG. 1, a toner cartridge 1 comprises a photosensitive drum 3 on which the electrostatic latent image is formed, a developing unit 10 for supplying the toner by a developing roller 11 to develop the electrostatic latent image and a waste toner removing unit 20 for removing the waste toner which remains on a surface of the photosensitive drum 3.

The waste toner removing unit 20 comprises a cleaning blade 21 which contacts with a surface of the photosensitive drum 3 and removes the waste toner remaining on a surface of the photosensitive drum 3, a waste toner transporting apparatus 30 for transporting the waste toner removed by the cleaning blade 21 and a waste toner housing 23 for receiving the transported waste toner.

Referring to FIG. 2, the waste toner transporting apparatus 30 comprises a toner transporting film 31, a film fixing member 32, a vibrating shaft 33, a driving cam 34 and an elastic member 36.

The film fixing member 32 is installed above the cleaning blade 21 and inclines downwardly toward the waste toner housing 23. The film fixing member 32 is fixed to the vibrating shaft 33 so as to vibrate from side to side, for example, in an axial direction with respect to the photosensitive drum 3 in FIG. 2. Accordingly, a size of the film fixing member 32 is smaller than that of the waste toner housing 23 which enables the film fixing member 32 to vibrate from side to side.

The toner transporting film 31 is provided above the film fixing member 32 and transports the waste toner removed from a surface of the photosensitive drum 3 by the cleaning blade 21 to the waste toner housing 23.

The vibrating shaft 33 passes through both side walls of the waste toner housing 23 parallel to the cleaning blade 21. The vibrating shaft 33 is also installed so that the vibrating shaft 33 can vibrate inside of the waste toner housing 23. Also, the film fixing member 32 is fixed to an upper side of the vibrating shaft 33. One end of the vibrating shaft 33 contacts with the driving cam 34 and the other end is supported elastically by the elastic member 36 such as the spring.

An inclined surface is formed at one end of the driving cam 34 and a gear 34*a* is provided at the other end of the driving cam 34. A power transmission member (not shown) transmits a power to the gear 34*a* and the photosensitive drum 3. The inclined surface of the driving cam 34 contacts with one end of the vibrating shaft 33. Accordingly, once the driving cam 34 is rotated, the vibrating shaft 33 moves in one direction via the inclined surface.

The elastic member 36 is installed such that the elastic member 36 can elastically support the other end of the vibrating shaft 33 in the direction which is opposite to the direction in which the vibrating shaft 33 is moved by the driving cam 34. Therefore, a contact state between one end of the vibrating shaft 33 and the inclined surface of the driving cam 34 can be maintained. Therefore, a rotational motion of the driving cam 34 is converted into a linear reciprocation motion of the vibrating shaft 33 by the structure as described above.

An operation of the waste toner transporting apparatus 30 as described above will now be described.

Once the photosensitive drum 3 rotates, the waste toner which remains on a surface of the photosensitive drum 3 is removed by the cleaning blade 21 and conveyed above the cleaning blade 21. At this time, since the toner transporting film 31 is provided above the cleaning blade 21, the removed waste toner accumulates on the toner transporting film 31. However, since the toner transporting film 31 inclines downwardly towards the waste toner housing 23 and is fixed to the film fixing member 32 which is vibrated from side to side by the driving cam 34 and the vibrating shaft 33, the waste toner does not accumulate on the cleaning blade 21 due to the vibration of the toner transporting film 31. Consequently, waste toner is transported to and received in the waste toner housing 23.

However, one drawback of the conventional waste toner transporting apparatuses 30 as described above, is that since the film fixing member 32 and the vibrating shaft 33 occupy a space of the waste toner housing 23, in order to receive an amount of waste toner which is the same as a volume of the waste toner housing 23, the waste toner housing 23 should have a relatively large size.

Additionally, a problem arises in that since the film fixing member 32 and the vibrating shaft 33 vibrate from side to side in the entire space of the waste toner housing 23, once the waste toner received in the waste toner housing 23 solidifies, the waste toner transporting apparatus 30 may not operate normally.

Moreover, since the vibrating shaft 33 passes through both side walls of the waste toner housing 23 and vibrates from side to side, a seal member may be provided to prevent the waste toner from leaking through holes formed on both side walls. Therefore, manufacturing costs may increase.

Accordingly, there is a need for an improved waste toner apparatus which limits the size of the waste toner housing and reduces manufacturing costs.

SUMMARY OF THE INVENTION

An aspect of the present invention is to address at least the above problems and/or disadvantages and to provide at least the advantages described below. Accordingly, an aspect of the present invention is to provide a waste toner transporting apparatus and a toner cartridge with the same which reduce the size of the waste toner housing due to, for example, a structure in which an additional film fixing member and a vibrating shaft are not necessary. Moreover, the waste toner apparatus according to an aspect of the present invention may limit the occurrence of operation errors.

Another object of the present invention is to provide a waste toner transporting apparatus and a toner cartridge with the same which may reduce manufacturing costs by limiting the amount of sealing members used for the waste toner housing.

According to an exemplary implementation of the present invention, the waste toner transporting apparatus comprises a toner transporting plate arranged substantially above a cleaning blade. A transporting member is installed at one side of the toner transporting plate and has a cam follower. A driving cam contacts with the cam follower and converts rotational motion into linear reciprocation to enable the toner transporting plate to reciprocate on the cleaning blade.

According to an exemplary implementation of the present invention, the waste toner transporting apparatus further comprise an elastic member elastically supporting the transporting member to enable the cam follower to continuously contact with the driving cam and a guide member formed in the waste toner housing to guide a reciprocation of the transporting member.

According to an exemplary implementation of the present invention, the toner transporting plate has a plurality of through holes formed thereon and a side section of the toner transporting plate, which corresponds to the cleaning blade may also be formed as substantially tooth shapes and the toner transporting plate may be made of an elastic material.

According to an exemplary implementation of the present invention, the toner transporting plate is to be supported by a plurality of guide ribs formed in the waste toner housing.

According to another exemplary implementation of the present invention, the toner cartridge may comprise a photosensitive drum on which the electrostatic latent image is formed, a developing unit supplying a toner to the photosensitive drum to develop the electrostatic latent image, a waste toner removing unit including a cleaning blade which removes waste toner remaining on a surface of the photosensitive drum and a waste toner housing which receives the removed waste toner. A waste toner transporting apparatus may include a toner transporting plate arranged above the cleaning blade and the waste toner housing, a transporting member provided at one side of the toner transporting plate and having a cam follower, and a driving cam which contacts with the cam follower and converts rotational motion into a linear reciprocation to enable the toner transporting plate to reciprocate on the cleaning blade.

In the waste toner transporting apparatus and the toner cartridge, as described in the exemplary implementations above, since the additional film fixing member and vibrating shaft requiring a space are not utilized, the size of the waste toner housing may be reduced, and operation errors of the apparatus can be limited.

In addition, since the toner transporting plate vibrates from side to side through a cam hole formed on one side surface of the waste toner housing, the waste toner according to an exemplary implementation may reduce manufacturing costs by limiting the amount of seals necessary to prevent leakage.

Other objects, advantages, and salient features of the embodiments of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
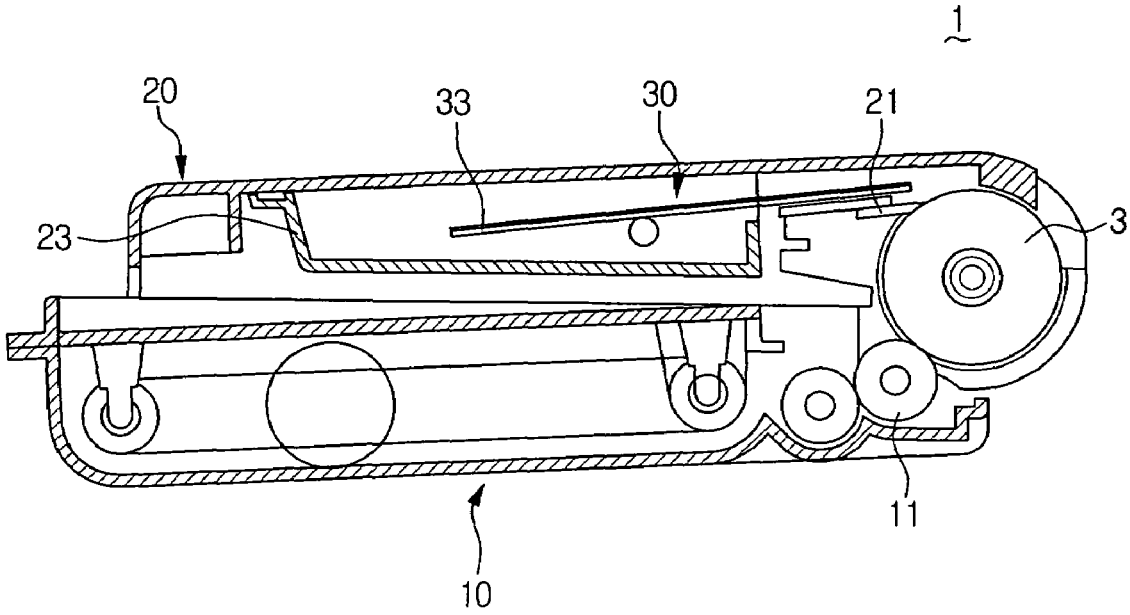
FIG. 1 (PRIOR ART)
FIG. 1 is a sectional view showing a conventional toner cartridge.
Figure 2:
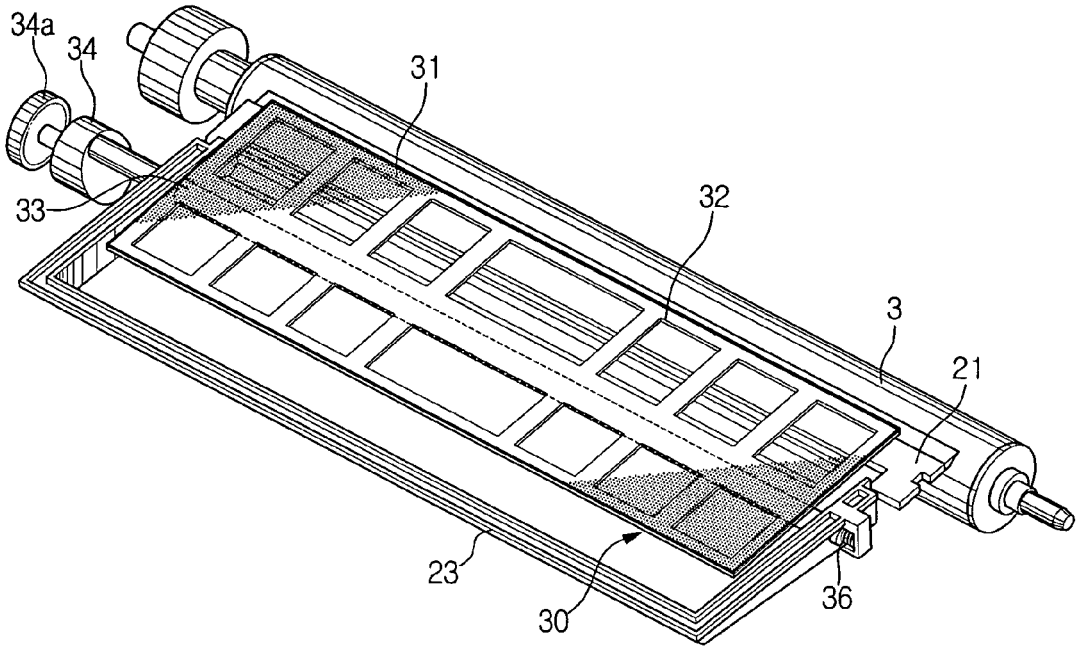
FIG. 2 (PRIOR ART)
FIG. 2 is a perspective view showing a conventional waste toner transporting apparatus.
Figure 3:
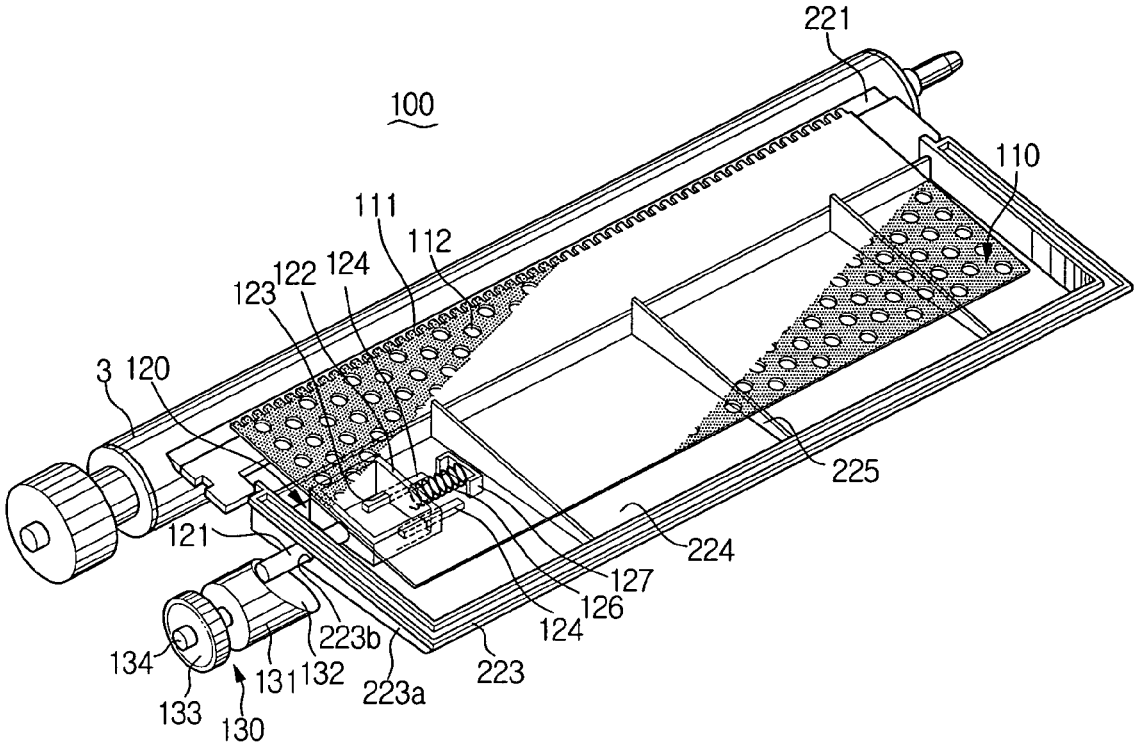
FIG. 3 is a perspective view showing a waste toner transporting apparatus according to an exemplary embodiment of the present invention.

Referring to FIG. 3, a waste toner transporting apparatus 100 according to an exemplary implementation of the present invention comprises a toner transporting plate 110, a transporting member 120 and a driving cam 130.

The toner transporting plate 110 is arranged above a cleaning blade 221. On a side of the cleaning blade 221, a waste toner housing 223 which receives the waste toner transported by the toner transporting plate 110 is provided below the toner transporting plate 110. Also, it may be desirable that a side surface 111 of the toner transporting plate 110, that is, the side surface 111 arranged above the cleaning blade 221 is U-shaped, for example, the shape of a tooth. Due to this structure, the waste toner removed from a surface of a photosensitive drum 3 by the cleaning blade 221 is transported relatively smoothly on the toner transporting plate 110. It may also be desirable to form a plurality of through holes 112 on the toner transporting plate 110 as shown in FIG. 3. Due to the through holes 112, the waste toner is distributed evenly prior to being received in the waste toner housing 223. Also, it may be desirable that the toner transporting plate 110 is made from an elastic material so that a vibration of the toner transporting plate 110 caused by the driving cam 130 is propagated, and the waste toner can be transported more evenly and smoothly in the waste toner housing 223. A plurality of guide ribs 225 on an inner bottom surface 224 of the waste toner housing 223 may also be provided to prevent the waste toner transporting plate 110 from sagging and to guide the waste toner transporting plate to enable smooth linear reciprocation. In order to support the toner transporting plate 110, which is inclined according to an inclination of the upper side of the transporting member 120 described below, the guide ribs 225 have an inclination corresponding to an inclination of the upper side of the transporting member 120. Also, the guide ribs 225 act as reinforcing ribs to reinforce the strength of the waste toner housing 223.

According to a direction of rotation of the driving cam 130, the transporting member 120 urges the toner transporting plate 110 to reciprocate from side to side. The transporting member 120 is provided at one end of the toner transporting plate 110 and a cam follower 121 is provided on a side which is opposite to the side to which the toner transporting plate 110 is fixed. It may also be desirable if the transporting member 120 is formed and guided by a guide member 124 which is provided on the inner bottom surface 224 of the waste toner housing 223. In this embodiment, as shown in FIG. 3, the transporting member 120 is formed to have a shape of a square pipe. The toner transporting plate 110 is fixed to an upper side of the transporting member 120 and the cam follower 121 is provided on a side surface of the transporting member 120 to which the toner transporting plate 110 does not extend. At this time, an upper side of the transporting member 120 inclines downward toward the waste toner housing 223 (see FIG. 4). A guide groove 123 is formed on a side surface 122 of the transporting member 120 which is opposite to the side surface on which the cam follower 121 is installed. The guide groove 123 is guided by the guide member 124. The side surface 122, on which the guide groove 123 is formed, is supported by an elastic member 126 such as a spring. As a result, the cam follower 121 contacts with an inclined surface 132 of the driving cam 130. This elastic member 126 is fixed to and supported by a supporting section 127 provided in the waste toner housing 223.

The driving cam 130 contacts with the cam follower 121 and converts a rotational motion into a linear reciprocation of the transporting member 120. Therefore, the toner transporting plate 110 reciprocates above the cleaning blade 221. In the driving cam 130, as shown in FIG. 3, a cam section 131 having the inclined surface 132 is formed at one end, and a gear 133 is formed at the other end. A power is transmitted from a power transmission member, which is not shown, to the gear 133 to rotate the driving cam 130 on a rotational shaft 134. At this time, it is desirable that power is transmitted from the power transmission member (not shown), which rotates the photosensitive drum 3, to the gear 133 of the driving cam 130. In this embodiment, the power is transmitted by the gear 133. In the case that the power is transmitted by a belt, a pulley is formed at another end of the driving cam 130. The driving cam 130 is installed such that an edge of the inclined surface 132 of the driving cam 130 contacts with the cam follower 121. Accordingly, once the driving cam 130 is rotated from a high point section to a low point section, the cam follower 121 is pushed to one side (right side in FIG. 3). Due to a difference of height from a high point section to a lower point section of the inclined surface 132 of the driving cam 130, a stroke of the transporting member 120 is determined.

Figure 4:
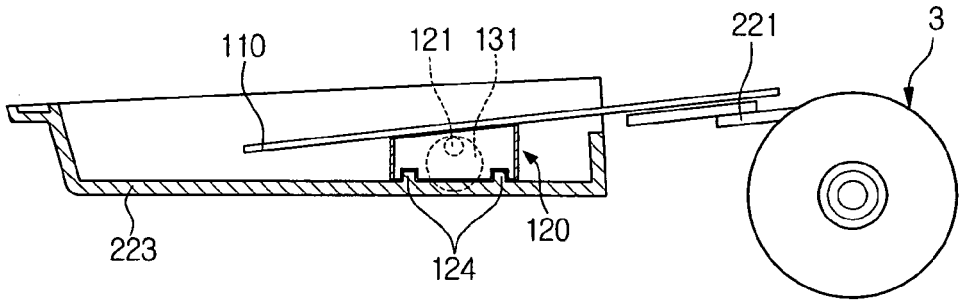
FIG. 4 is a sectional view of the waste toner transporting apparatus shown in FIG. 3.

An operation of the waste toner transporting apparatus 100 according to one embodiment of the present invention as described above will now be described with reference to FIG. 3 and FIG. 4.

Once the photosensitive drum 3 is rotated, the waste toner remaining on a surface of the photosensitive drum 3 is removed by the cleaning blade 221 and conveyed above an upper side of the cleaning blade 221. At this time, since the toner transporting plate 110 is provided above the upper side of the cleaning blade 221, the removed waste toner is conveyed on the toner transporting plate 110. At this time, since the toner transporting plate 110 inclines downward toward the waste toner housing 223 and vibrates from side to side (in an axial direction of the photosensitive drum 3 in FIG. 3) by the driving cam 130 and the transporting member 120, the waste toner on the toner transporting plate 110 is conveyed to and received in the waste toner housing 223.

The reciprocation (hereinafter referred as "horizontal vibration") of the toner transporting plate 110, caused by the driving cam 130 and the transporting member 120, will now be described in more detail.

In the state that the cam follower 121 of the transporting member 120 contacts with the low point section of the inclined surface 132 of the driving cam 130, once the driving cam 130 is rotated by the power transmitted from the power transmission member (not shown), the cam follower 121 contacts gradually with the high point section of the inclined surface 132. Thus, the transporting member 120 is pushed in one direction (to a right side of FIG. 3). At this time, the elastic member 126 which elastically supports the transporting member 120 is compressed. Once the cam follower 121 passes the high point section of the inclined surface 132 and moves to the low point section by a continuous rotation of the driving cam 130, the transporting member 120 is pushed in the opposite direction (to a left side of FIG. 3) via a biasing force of the elastic member 126. That is, the transporting member 120 vibrates from side to side via the driving cam 130 and the elastic member 126. Accordingly, the toner transporting plate 110 fixed to an upper side of the transporting member 120, also vibrates from side to side. At this time, the toner transporting plate 110 vibrates from side to side with the amplitude as much as a difference of height between the lower point section and the high point section of the inclined surface 132 of the driving cam 130.

Figure 5:
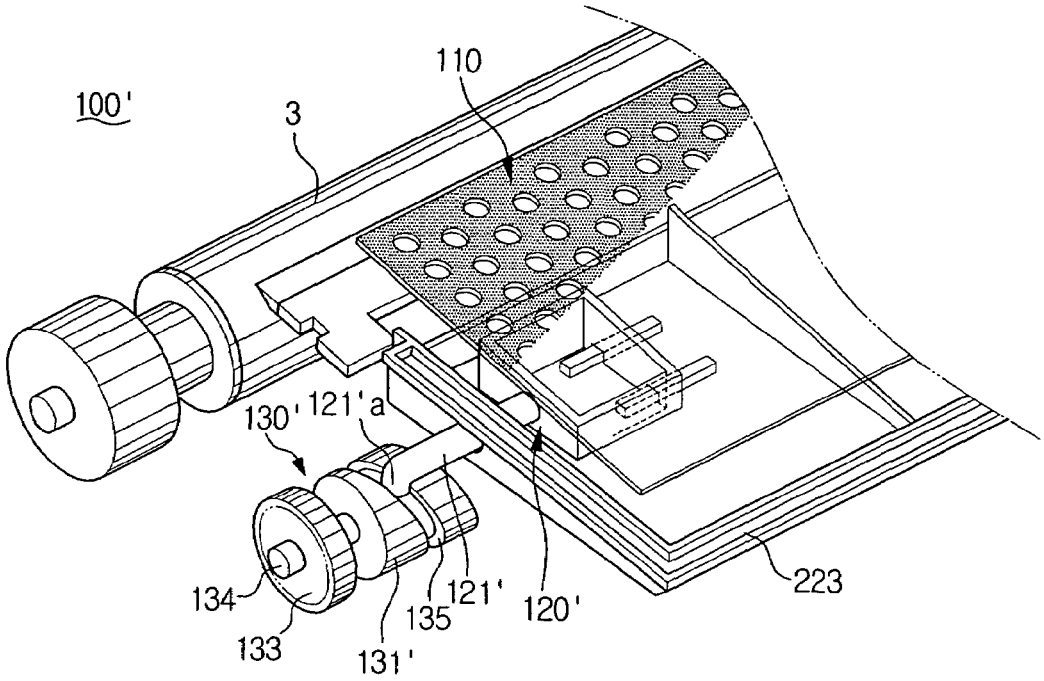
FIG. 5 is a perspective view showing another exemplary embodiment of the waste toner transporting apparatus.

Referring to FIG. 5, a waste toner transporting apparatus 100' according to another exemplary implementation of the present invention comprises a toner transporting plate 110, a transporting member 120' and a driving cam 130'.

In the driving cam 130', a cam section 131' is formed at one end and a gear 133 is formed at the other end. As shown in FIG. 5, the cam section 131' is of a cylindrical shape and has a cam groove 135 inclined in a longitudinal direction and formed on an outer circumference thereof. An end portion 121'*a* of a cam follower 121' is inserted in this cam groove 135. Accordingly, once the driving cam 130' is rotated, the cam follower 121' is vibrated from side to side along the cam groove 125. Once the cam follower 121' is vibrated, the toner transporting plate 110, which is fixed to the transporting member 120' on which the cam follower 121' is formed, is also vibrated from side to side. Power is transmitted from the power transmission member (not shown) to the gear 133 to rotate the driving cam 130'. At this time, it is desirable that the power is transmitted from the power transmission member, which rotates the photosensitive drum 3, to the gear 133 of the driving cam 130'.

The cam follower 121' is formed on one side surface of the transporting member 120' and the end portion 121'*a* of the cam follower 121' is formed to have a shape corresponding to the cam groove 135 of the driving cam 130'.

The toner transporting plate 110 and the transporting member 120' are substantially the same as those described in the above described embodiment, and so the detailed description thereof is omitted for clarity and conciseness. However, in the waste toner transporting apparatus 100' according to the exemplary implementation, since the transporting member 120' is vibrated from side to side by the cam follower 121' inserted in the cam groove 135, it is not necessary to install the elastic member 126 (see FIG. 3) supporting the transporting member 120' toward the driving cam 130.

Hereinafter, one embodiment of the toner cartridge provided with the waste toner transporting apparatus according to yet another exemplary implementation of the present invention is described in conjunction with accompanying FIG. 6.

Figure 6:
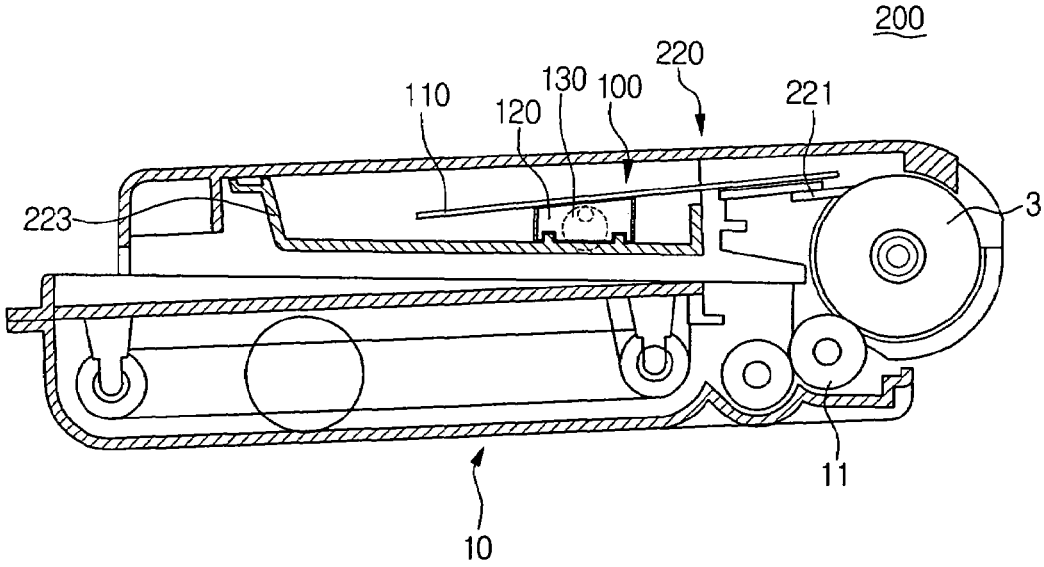
FIG. 6 is a sectional view of an exemplary embodiment of a toner cartridge having the waste toner transporting apparatus according to the present invention.

Referring to FIG. 6, a toner cartridge 200 comprises a photosensitive drum 3, a developing unit 10 and a waste toner removing unit 220.

An electrostatic latent image is formed on a surface of the photosensitive drum 3 by a laser beam irradiated from an exposure unit (not shown), the photosensitive drum 3 is rotated by a power transmission member (not shown).

A certain amount of the toner is stored in the developing unit 10 and the toner is supplied to the photosensitive drum 3 by a developing roller 11 to develop the electrostatic latent image formed on a surface of the photosensitive drum 3.

The waste toner removing unit 220 removes the waste toner remaining on a surface of the photosensitive drum 3 and comprises a cleaning blade 221 a waste toner transporting apparatus 100 and a waste toner housing 223.

The cleaning blade 221 contacts with a surface of the photosensitive drum 3 and removes the waste toner remaining on a surface of the photosensitive drum 3.

The waste toner transporting apparatus 100 comprises a toner transporting plate 110, a transporting member 120 and a driving cam 130, a structure and function of each element are substantially the same as those of each structural element in the exemplary implementations as described above, thus a detailed description thereof is omitted for clarity and conciseness.

The waste toner housing 223 receives the waste toner transported by the waste toner transporting apparatus 100 and is provided with the waste toner transporting apparatus 100 installed therein. Accordingly, a cam hole 223*b* (FIG. 3), through which the cam follower 121 of the transporting member 120 can reciprocate, is formed on one side surface 223*a* (FIG. 3) of the waste toner housing 223. The cam hole 223*b* is sealed to prevent the waste toner from leaking when the cam follower 121 reciprocates. Also, the guide member 124 is formed on the inner bottom surface 224 of the waste toner housing 223 to guide the transporting member 120, and the plurality of guide ribs 225 are formed on the bottom surface 224 of the waste toner housing 223 to support the toner transporting plate 110 which is vibrated from side to side. At this time, an upper side of each guide rib 225 is formed as the inclined surface corresponding to an inclination of the toner transporting plate 110 (see FIG. 3).

An operation of the toner cartridge 200 having the structural elements as described above is described below in conjunction with FIG. 3 and FIG. 6.

Once the printing process is initiated, a laser beam is irradiated to the photosensitive drum 3 to form an electrostatic latent image on the photosensitive drum 3. Once the photosensitive drum 3 is rotated, the electrostatic latent image formed on the photosensitive drum 3 is developed by the toner supplied by the developing roller 11 of the developing unit 10, and a visible image is formed. The photosensitive drum 3 is rotated continuously and the formed visible image is transferred to a printing medium by a transferring roller (not shown). After the visible image is transferred, the waste toner remaining on a surface of the photosensitive drum 3 is removed by the cleaning blade 221 and then transported to above the toner transporting plate 110. At this time, since the toner transporting plate 110 inclines downwardly toward the waste toner housing 223 and vibrates from side to side by the driving cam 130 and the transporting member 120, the waste toner transported above the toner transporting plate 110 is received in the waste toner housing 223.

One exemplary implementation of the image forming apparatus using the toner cartridge provided with the waste toner transporting apparatus as described above is shown in FIG. 7.

Figure 7:
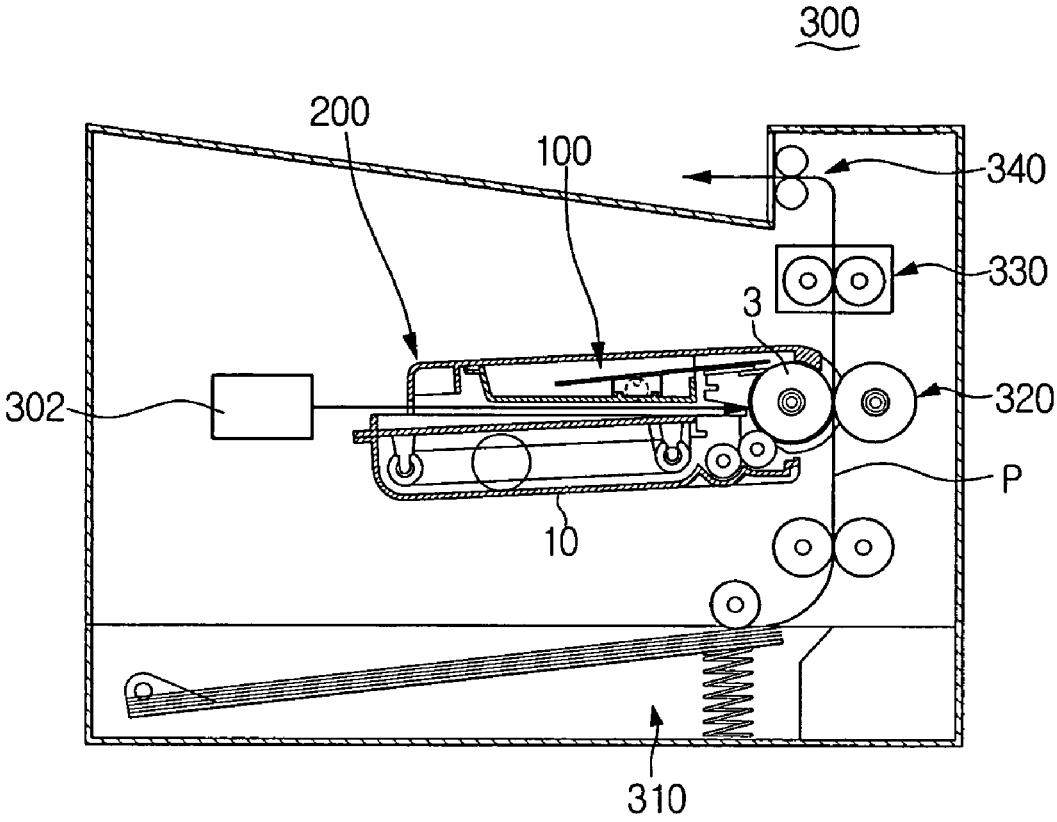
FIG. 7 is a view schematically showing an image forming apparatus comprising the toner cartridge according to exemplary embodiments of the present invention.

Referring to FIG. 7, an image forming apparatus 300 comprises a dispensing unit 310 which stores printing media P and dispenses the printing medium one by one, the toner cartridge 200 which forms the image corresponding to printing data, a transferring roller 320 to transfer the image formed on the photosensitive drum 3 of the toner cartridge 200 to the printing medium P transported from the dispensing unit 310, a fixing unit 330 to fix the image transferred onto the printing medium P, and a discharging unit 340 to discharge the printing medium P on which the image is fixed to an outside of the apparatus 300.

Accordingly, once the image forming apparatus 300 receives the printing commands, an exposure unit 302 irradiates the laser beam corresponding to the printing data to form the electrostatic latent image on a surface of the photosensitive drum 3. Then, the electrostatic latent image is developed by the developing unit 10 of the toner cartridge 200 to form the visible image. The formed image is transferred to the printing medium P by the transferring roller 320. After the image is transferred to the printing medium P, the waster toner remaining on a surface of the photosensitive drum 3 is removed by the cleaning blade 221, and then the removed waste toner is received in the waste toner housing 223 by the waste toner transporting apparatus 100 as described above. The printing medium P, on which the image is transferred, passes through the fixing unit 330 to fix the image to the printing medium P, and then the printing medium P, to which the image is fixed, is discharged to an outside by the discharging unit 340.

While the invention has been shown and described with reference to certain embodiments thereof, it will be understood by those skilled in the art that various changes in form and details may be made therein without departing from the spirit and scope of the invention as defined by the appended claims.

What is claimed is:

1. A waste toner transporting apparatus, comprising:

a toner transporting plate arranged substantially above a cleaning blade;

a transporting member installed at one side of the toner transporting plate and the transporting member comprising a cam follower; and a driving cam contacting the cam follower which converts rotational motion into reciprocating motion to enable the toner transporting plate to reciprocate on the cleaning blade.

2. The waste toner transporting apparatus according to claim 1, wherein the waste toner transporting apparatus further comprises an elastic member which elastically supports the transporting member to enable a portion of the cam follower to continuously contact the driving cam.

3. The waste toner transporting apparatus according to claim 1, wherein the waste toner transporting apparatus further comprises a guide member positioned in a waste toner housing to guide reciprocation of the transporting member.

4. The waste toner transporting apparatus according to claim 1, wherein the toner transporting plate comprises a plurality of through holes.

5. The waste toner transporting apparatus according to claim 1, wherein a side section of the toner transporting plate corresponds to the cleaning blade and comprises at least one substantially U- shaped member.

6. The waste toner transporting apparatus according to claim 1, wherein the toner transporting plate is supported by a plurality of guide ribs arranged in a waste toner housing.

7. The waste toner transporting apparatus according to claim 1, wherein the toner transporting plate comprises an elastic material.

8. A toner cartridge, comprising:

a photosensitive drum on which an electrostatic latent image is formed;

a developing unit supplying toner to the photosensitive drum to develop the electrostatic latent image;

a waste toner removing unit comprising a cleaning blade which removes waste toner remaining on a surface of the photosensitive drum and a waste toner housing which receives the removed waste toner;

a waste toner transporting apparatus comprising a toner transporting plate arranged substantially above the cleaning blade and the waste toner housing, a transporting member provided at one side of the toner transporting plate comprising a cam follower; and a driving cam contacting the cam follower and converting rotational motion into reciprocating motion to enable the toner transporting plate to reciprocate on the cleaning blade.

9. The toner cartridge according to claim 8, wherein the waste toner transporting apparatus further comprises an elastic member elastically supporting the transporting member to enable the cam follower to continuously contact the driving cam.

10. The toner cartridge according to claim 8, wherein the waste toner transporting apparatus further comprises a guide member arranged in the waste toner housing which guides reciprocation of the transporting member.

11. The toner cartridge according to claim 8, wherein the toner transporting plate comprises a plurality of through holes.

12. The toner cartridge according to claim 8, wherein a side section of the toner transporting plate corresponds to the cleaning blade and comprises at least one substantially U-shaped member.

13. The toner cartridge according to claim 8, wherein the toner transporting plate is supported by a plurality of guide ribs arranged in the waste toner housing.

14. The toner cartridge according to claim 8, wherein the toner transporting plate comprises an elastic material.

* * * * *